United States Patent [19]

Barta

[11] 4,376,276

[45] Mar. 8, 1983

[54] DOOR ALARM WITH FLEXIBLE SWITCH ACTUATOR

[76] Inventor: Jesse Barta, 3141 River Forest Dr., Fort Wayne, Ind. 46805

[21] Appl. No.: 302,064

[22] Filed: Sep. 14, 1981

[51] Int. Cl.[3] ..... G08B 13/08

[52] U.S. Cl. ..... 340/545; 200/61.62; 200/61.93; 340/549; 340/693

[58] Field of Search ..... 340/545, 546, 693, 549; 200/61.93, 61.62

[56] References Cited

U.S. PATENT DOCUMENTS

| | | | |
|---|---|---|---|
| 2,093,085 | 9/1937 | Ludwig | 200/61.62 |
| 3,029,425 | 4/1962 | Forrester | 340/549 |
| 3,266,029 | 8/1966 | Callahan | 340/545 |
| 3,312,968 | 4/1967 | Kiefer, Jr. | 340/545 |
| 3,453,613 | 7/1969 | Kay | 340/549 |
| 3,541,276 | 11/1970 | Lea | 200/61.93 |
| 3,968,337 | 7/1976 | Cole | 200/61.62 |
| 4,186,287 | 1/1980 | Scott | 200/61.62 |
| 4,194,193 | 3/1980 | McDonough | 340/545 |
| 4,277,781 | 7/1981 | Hunyadi | 340/545 |

*Primary Examiner*—Glen R. Swann, III

*Attorney, Agent, or Firm*—Gust, Irish, Jeffers & Hoffman

[57] ABSTRACT

The alarm mechanism is electrically operated and includes an electrical switch having an arm which projects beyond the alarm's housing. The arm is semi-rigid and flexible such that it may be engaged to actuate the switch yet will deflect to one side to permit passage of a door engaged therewith during opening. The housing is mounted on a wall immediately adjacent to the door with the arm extending along side the door. Upon opening the door, the arm is engaged thereby sounding the alarm. The housing is frictionally and rotationally mounted on the wall such that it may be swung to a position in which the arm is moved out of interfering or engageable relation with the door.

14 Claims, 8 Drawing Figures

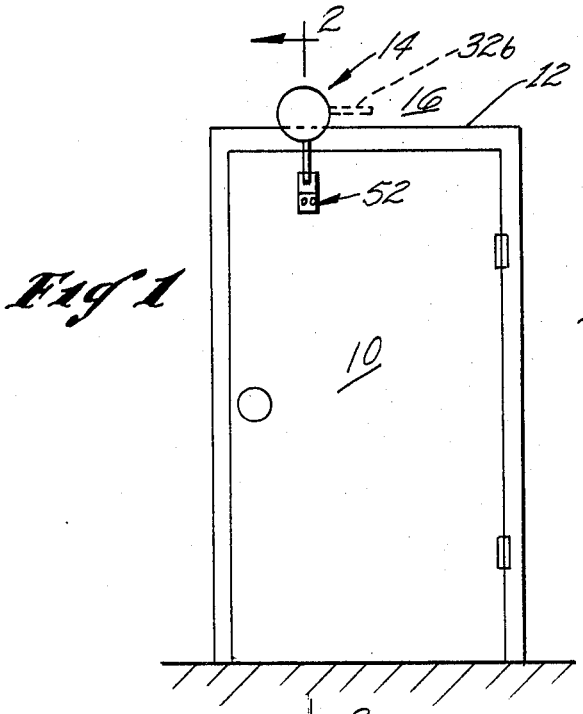
Fig 1
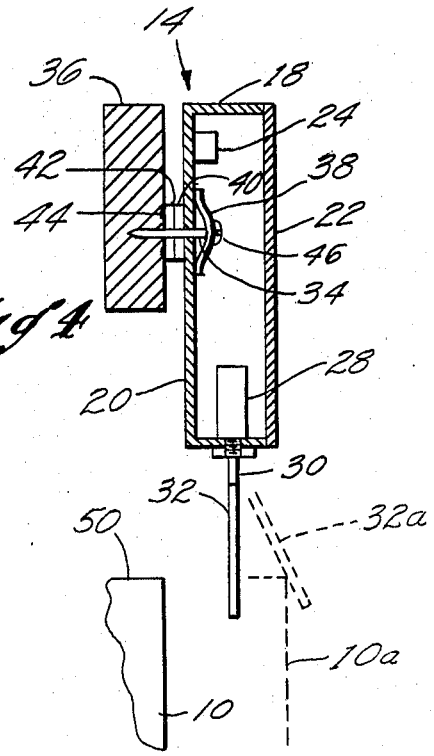
Fig 4
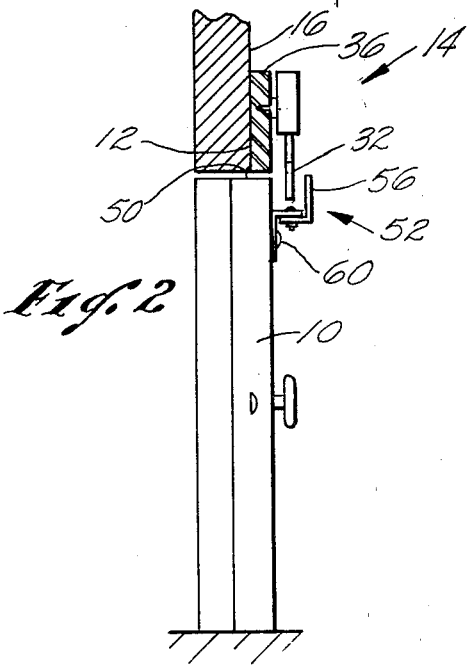
Fig. 2
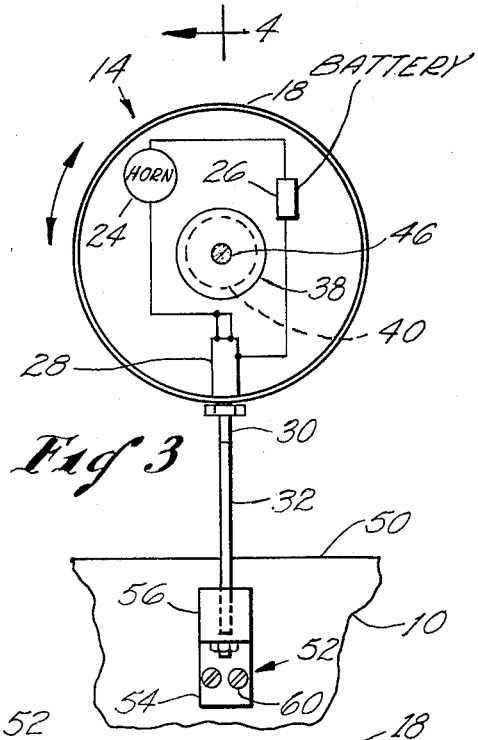
Fig 3
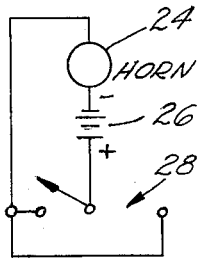
Fig 5
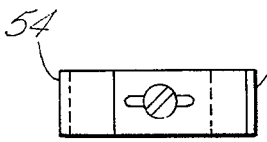
Fig. 7
Fig 6
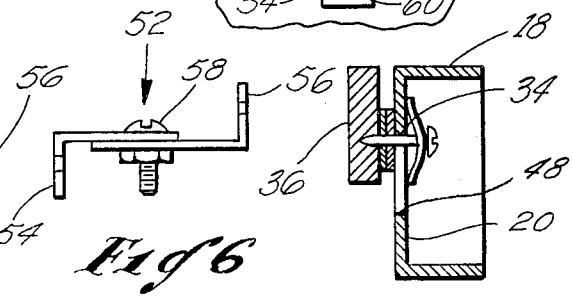
Fig. 8

DOOR ALARM WITH FLEXIBLE SWITCH ACTUATOR

BACKGROUND OF THE INVENTION

1. Field of the Invention

The present invention relates to a door alarm device, and more particularly to an alarm device movable mounted on a wall adjacent to a door so as to be manually positionable either in armed or disarmed condition.

2. Description of the Prior Art

Various door alarms are well known, typical of these being disclosed in U.S. Pat. Nos. 3,029,425; 3,266,029; 3,312,968; 3,453,613; 4,194,193 and 4,277,781.

SUMMARY OF THE INVENTION

This invention is a door alarm device comprising a support, an electrical alarm device carried by the support which includes an elongated actuating arm that projects laterally beyond the support. The arm is movable between two spaced positions for actuating and deactuating, respectively, the alarm, this arm having a degree of flexibility whereby transverse engagement therewith by a door during opening deflects the arm to one side while moving it between the aforesaid positions. Means are provided for mounting the support on a stationary object immediately adjacent to the door whereby the support may be moved between arming and disarming positions relative to the door.

In one form of the invention, the support is a housing and the mounting means includes a pivotal mount whereby the housing may be rotated for swinging the arm between the aforesaid two positions, one of such positions being for the purpose of arming the alarm and the other position for disarming.

It is an object of this invention to provide a door alarm device which is simple, economical and easily adjusted.

The above-mentioned and other features and objects of this invention and the manner of attaining them will become more apparent and the invention itself will be best understood by reference to the following description of an embodiment of the invention taken in conjunction with the accompanying drawings.

BRIEF DESCRIPTION OF THE DRAWINGS

In the drawings, FIG. 1 is a front elevation of one embodiment of this invention showing an alarm device mounted relative to a conventional door;

FIG. 2 is a sectional view taken substantially along section line 2—2 of FIG. 1;

FIG. 3 is a fragmentary, enlarged front view showing a portion of the door of the preceding figures and the alarm device mounted relative thereto;

FIG. 4 is a cross section taken substantially along section line 4—4 of FIG. 3;

FIG. 5 is a circuit diagram of the electrical circuitry used in the alarm device;

FIGS. 6 and 7 are side and front views, respectively, of a bracket mountable on the door for use in acutating the alarm device; and FIG. 8 is a section like FIG. 4 of a slightly different embodiment of this invention.

DESCRIPTION OF THE PREFERRED EMBODIMENT

A preferred embodiment is shown in FIGS. 1 through 7. A typical door 10 is hingedly mounted within a door frame 12. An alarm device generally indicated by the numeral 14 is movably mounted on the wall 16 or door frame 12 as preferred immediately adjacent to the door 10. This alarm device 14 includes a cylindrical housing 18 having a rear side or wall 20 and a removable cover 22. Mounted within the housing 18 are the alarm elements which include an electrically energizable, audible horn 24, a battery 26 and a single pole double throw switch 28. These elements are connected together in a series circuit as shown in FIG. 5. The switch 28 includes the usual switch arm 30 which extends through the side of the housing 18. To the distal end of the switch arm is an arm extension 32 of some suitable, resiliently flexible material such as rubber or spring steel. If rubber, the extension 32 is semi-rigid and preferably is molded to the distal end of the arm 30. If spring steel, it may be welded or secured by means of threaded fasteners. The extension 32 is sufficiently rigid that upon movement back and forth, the switch arm 30 will be correspondingly moved to operate the switch 28 between its neutral and opposite contact positions.

The housing 18 is movably mounted on a stationary object such as the door frame 12 or wall 16. In the embodiment shown, the movement is rotational, this being provided by means of a pin or screw 34 which passes through the center of the rear wall 20 to be threaded into a block 36 of wood or the like which in turn is secured by some suitable means to the wall 16. Friction washers or discs are provided on opposite sides of the housing wall 20, these being indicated by the numerals 38, 40 and 42. All of these discs are provided with apertures which receive the screw 34 as shown. The disc 38 is cup-shaped and is made of spring steel. The two discs 40 and 42 may be made of either metal or plastic and are frictionally engaged with each other. The disc 42 preferably is provided indentations or suitable bosses 44 which embed into the wood or block 36 thereby to prevent rotation or movement of the disc 42 relative to the block 36.

The screw 34 has a head 46 which engages the disc 38 as shown. Upon tightening the screw 34, the head 46 engages the disc 38 thereby compressing it against the housing panel 20 and the latter in turn against the two discs 42 and 44. The housing 18 is thereby frictionally rotationally mounted on the block 36 such that the housing 18 may be manually rotated to any given position about the screw 34 where it will remain until further moved. This movement serves in arming and disarming the alarm device.

An alternative arrangement to the pivotal mounting just described is that shown in FIG. 8 wherein the housing 18 may be rectilinearly moved upwardly or downwardly as desired. This arrangement is substantially identical to that shown in FIG. 4 with the exception that instead of a hole in the rear wall 20 for receiving the screw 34, an elongated slot 48 is used instead. By means of the slot 48, the housing 18 may be moved vertically for arming and disarming the alarm device.

The alarm device 14 is so positioned with respect to the door 10 as to juxtapose the arm extension 32 alongside the door as clearly shown in FIGS. 1 through 4. This position is further determined to be such that upon opening the door 10 toward the right as viewed in FIGS. 2 and 4, the top edge of the door 50 will engage the side of the arm extension 32 about midway between the ends thereof deflecting the latter to the dashed-line position **32*a* as shown in FIG. 4. This deflection serves in actuating the switch arm 30 thereby closing one of the switch contacts to sound the horn 24**.

Since not all doors open in the same direction, means are provided for actuating the switch 28 should the door open oppositely, or in other words toward the left as viewed in FIG. 2. For this purpose, a Z-shaped bracket generally indicated by the numeral 52 is used, this bracket being shown in enlarged detail in FIGS. 6 and 7. The bracket is made in two L-shaped parts, the first having a mounting flange 54 and the other having a like mounting flange 56. The shank portions thereof are overlapped and slotted as shown, the typical threaded fastener 58 being received through the slots and tightened for holding the bracket parts in adjusted position.

The flange 54 is secured to the door 10 by means of suitable threaded fasteners 60. The flange 56 is disposed to be laterally opposite the arm extension 32 as more clearly shown in FIGS. 1, 2 and 3. Thus, upon opening the door 10 to the left as viewed in FIG. 2, the end flange 52 will engage the arm extension 32 to operate the switch 28 thereby to sound the alarm.

Since the arm extension 32 is flexible, the door 10 can be completely opened therepast. The switch 28 is of the type that once the arm 30 thereof is operated, it will remain in that position thereby maintaining the contacts closed. The alarm will therefore sound until the switch arm 30 is manually returned to its neutral or "off" position.

Use of the invention will now be explained. For arming the device, the housing 18 is rotated to the position shown in FIGS. 1 through 4 in which the arm extension 32 is juxtaposed with respect to the upper edge portion of the door 10. Upon opening the door 10 toward the right, the upper edge portion of the door engages the arm extension 32 deflecting it sideways as shown in FIG. 4 thereby actuating the switch 28. This closes the circuit to the horn 24 causing it to sound an alarm. The alarm will continue to sound, since the switch 28 has been turned "on" and will remain in this position until manually returned to its neutral "off" position. If the door 10 should be opened toward the left, then the end flange 56 will engage and operate the arm extension 32 to sound the alarm.

Since the arm extension 32 is flexible, the door 10 can be opened fully therepast without breaking or damaging any part of the device.

Should it be desired to disarm the device 14, it is only necessary to move it out of position relative to the door 10. This is accomplished for the embodiment of FIGS. 1 through 4 by merely rotating the housing 18 about the pin 34. This swings the arm extension 32 to the side such that the door 10 can be opened in either direction without engaging extension 32. A typical position for the arm extension is indicated by the dashed line **32*b* in FIG. 1**.

For the embodiment in FIG. 8, it would only be necessary to move the housing 18 upwardly a distance sufficient to raise the lower extremity of the extension 32 out of interfering relation with the door 10. The slot 48 is long enough to permit movement for this distance, and extends generally parallel to the arm extension such that movement of the housing 18 can move the extension 32 out of the path of the door.

By providing a single pole double throw switch for the switch 28, the apparatus becomes usable for either direction of swinging of the door 10. However, the switch 28 may be of the single pole single throw type. For opposite operation, this switch need only be turned around on the device 14. The alarm therefor becomes useable with doors irrespective of the direction of opening.

While there have been described above the principles of this invention in connection with specific apparatus, it is to be clearly understood that this description is made only by way of example and not as a limitation to the scope of the invention.

What is claimed is:

1. A door alarm comprising a support, an electrical alarm device carried by said support and including an elongated actuating arm that projects laterally beyond said support, said arm being movable between two spaced positions for actuating and deactuating, respectively, said alarm, said arm having a degree of flexibility whereby transverse engagement therewith by a door will deflect it to one side while moving it between said positions, and means mounting said support on a stationary object for movement between and holding said support in arming and disarming positions.

2. The door alarm of claim 1 wherein said means includes a pivot pin centrally of said support.

3. The door alarm of claim 2 wherein said support includes a casing having a wall spaced from a plane including said arm, said pin passing through said wall.

4. The alarm of claim 3 wherein said means further includes two slip discs, said discs rotationally engaging opposite surfaces, respectively, of said wall, said pin passing through said discs.

5. The alarm of claim 4 wherein said pin is in the form of a screw having a head, one of said discs being cup shaped and formed of spring material and further being sandwiched between said head and the adjacent surface of said wall.

6. The alarm of claim 1 including in combination a wall having a door opening and a door hingedly mounted on said wall in registry with said opening, said support being mounted on said wall out of interferring relation with the operation of said door but with said arm extending alongside and in substantial parallelism with said door whereby said door operatively engages said arm during opening thereof, said means mounting said support on said wall such that said arming and disarming positions dispose said arm in and out of operative engageability, respectively, with said door.

7. The device of claim 6 including an element on said door normally disposed out of operative engagement with said arm but which engages the latter upon opening said door.

8. The device of claim 7 wherein said element is a bracket having an abutment spaced from said door but juxtaposed with respect to said arm.

9. The device of claim 7 wherein said bracket is "Z" shaped with one end flange secured to the door and the other end flange juxtaposed with respect to said arm, said abutment being said other end flange.

10. The device of claim 6 wherein said support is rotated to move it between said armed and said disarmed positions.

11. The device of claim 5 including an electrical switch connected to and operated by said arm, an electrically energizable horn and a battery connected in a series circuit, said arm when actuated serving to operate said switch which in turn connects said battery to said horn, said switch being of the single pole double throw type.

12. The device of claim 1 wherein said means includes a friction device which holds said support in adjusted position.

13. The device of claim 1 wherein said means includes a pin and slot device whereby said support can be moved rectilinearly.

14. The device of claim 13 wherein said support includes a housing having a rear wall said slot being in said rear wall, said arm extending generally in the same direction as said slot.

* * * * *